United States Patent [19]

Lowther, Sr.

[11] 4,424,018

[45] Jan. 3, 1984

[54] FLEXIBLE FIRELIGHTER

[76] Inventor: Roy E. Lowther, Sr., 8651 Foothill Blvd., Space 196, Rancho Cucamonga, Calif. 91730

[21] Appl. No.: 301,954

[22] Filed: Sep. 14, 1981

[51] Int. Cl.[3] ..... F23D 3/16

[52] U.S. Cl. ..... 431/288; 431/146; 431/345; 44/35

[58] Field of Search ..... 431/288, 289, 345, 290, 431/315, 120, 298, 146; 44/34, 35, 38–40; 294/19 R, 9

[56] References Cited

U.S. PATENT DOCUMENTS

| | | | |
|---|---|---|---|
| 38,672 | 5/1863 | Gleason . | |
| 40,734 | 12/1863 | Clinton . | |
| 47,207 | 4/1865 | Houchin . | |
| 74,033 | 2/1868 | Assmann | 431/345 |
| 282,522 | 8/1883 | Houchin . | |
| 282,578 | 8/1883 | Skinner . | |
| 1,069,530 | 8/1913 | Coleman . | |
| 2,406,518 | 8/1946 | Urbank | 67/22 |
| 2,461,124 | 2/1949 | Muzzy | 431/289 |
| 2,574,968 | 11/1951 | Harriman et al. | 431/146 |
| 2,722,816 | 11/1955 | Brautigan | 67/6 |
| 2,781,653 | 2/1957 | Thompson | 431/345 |
| 2,785,556 | 3/1957 | Smith | 431/290 |
| 3,138,944 | 6/1964 | Gauthier | 431/345 |
| 4,260,366 | 4/1981 | Karlyk | 431/298 |

*Primary Examiner*—Samuel Scott
*Assistant Examiner*—Margaret A. Focarino
*Attorney, Agent, or Firm*—Leo R. Carroll

[57] ABSTRACT

An improved device for safer lighting of gas or candle fires. The device comprises a flexible tube connected to a hand-held body member, through which a wick is passed. The soft metal tube may be bent into compound angles to ease access of the lighter to the fuel source in difficult to light applications, such as hot water heaters. An end cap on the body member may be configured for candle snuffing use, or may be replaced by a length extension member.

6 Claims, 2 Drawing Figures

FLEXIBLE FIRELIGHTER

BACKGROUND OF THE INVENTION

The invention relates generally to manually operated devices for transfer fire lighting, and more particularly to those utilized for gas and candle lighting. While not limited thereto, the device finds special application in difficult access applications, such as hot water heaters, because of its adjustable shape feature.

Various devices have long existed to light candle or gas lights. For instance, E. P. Gleason in U.S. Pat. No. 38,672 shows a fixed straight taper holder for lighting candles, while T. W. Houchin in U.S. Pat. No. 47,207 provides a curved holder for an internal taper moved by sash cord.

The problem of lighting without chimney removal is met by H. D. Coleman in U.S. Pat. No. 1,069,530 by adding a celluloid wick extender from the flame point to the chimney exit. In U.S. Pat. No. 2,406,518, J. C. Urband discloses a combined snuffer-holder in which a slidable taper is made bendable by a segmented construction, while D. Brautigan adds a spring actuated snuffer in U.S. Pat. No. 2,722,816.

None of the above devices are designed to be adaptable to the extreme variety of flame locations found in more modern gas or candle devices. Modern candle lights come with a variety of tall narrow chimneys requiring either a special taper or chimney removal before lighting. Many designs of gas hot water heaters and ovens exist for instance, which still require manual gas lighting of remote flame locations with restricted access.

Indeed, many of these gas devices do not permit a straight match type lighter to be placed close to the gas source. They therefore only light when the escaping gas reaches the flame—a dangerous, explosive situation.

A need exists therefore for a single flexible lighter which can be adjusted for use in a variety of lighting applications. This is best achieved by bending the holder, rather than the taper, into specific compound shapes. This will allow the lit end of the taper to be placed in close proximity of the intended flame location.

SUMMARY OF THE INVENTION

It is therefore, a primary object of this invention to provide a firelighter with a shape which is adjustable to permit the lighting wick to be placed near the source to be lit.

It is a further object to provide a thin tube firelighter which can be bent around obstacles.

It is a further object to provide a firelighter design which improves safety by allowing increased separation between body and flame.

It is a further object to provide a firelighter with a simple low cost manual wick feed feature.

It is a further object to provide a lamplighter with a built-in end cap snuffer feature.

It is a further object to provide a lamplighter whose safety may be further increased by means of a simple handle extension.

Other objects and advantages of the present invention will become more readily apparent upon having reference to the accompanying drawings and the following description.

DESCRIPTION OF THE PREFERRED EMBODIMENT

Figures 1, 2:
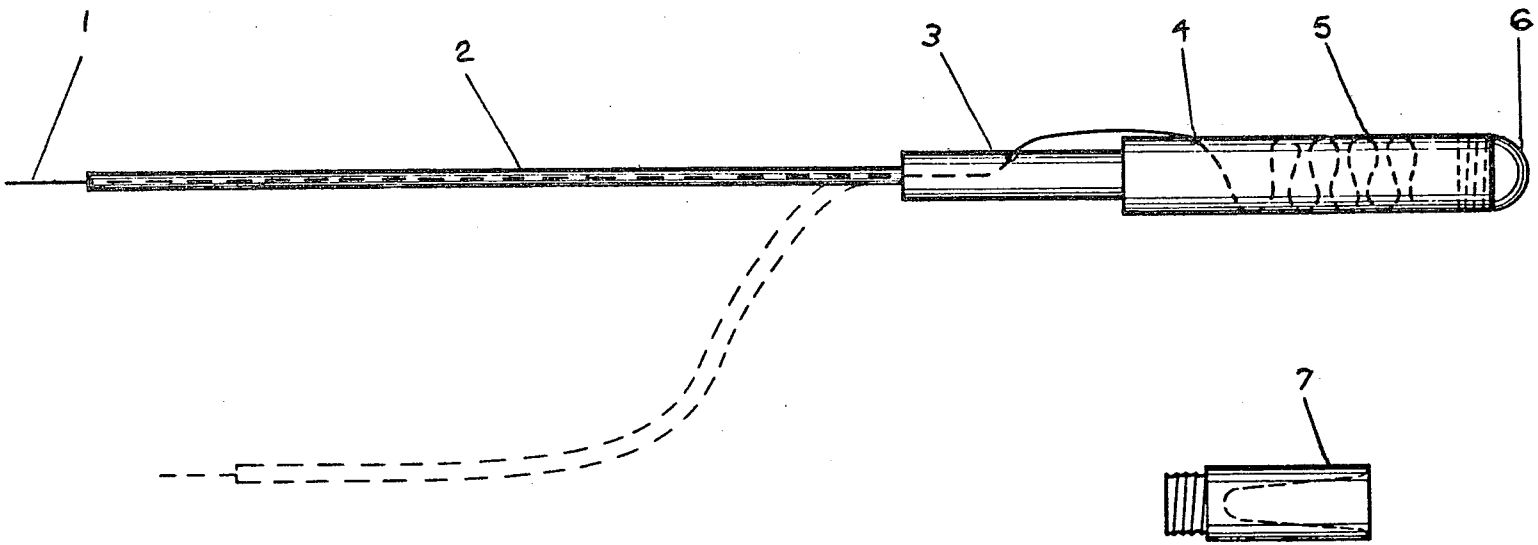
FIG. 1 is a side elevation view of the invention.
FIG. 2 is a side elevation of an elternate end-cap.

In the embodiment illustrated in FIG. 1, the device is shown in side view, with the adjustable tube 2 also shown in phantom. Tube 2 is a hollow thin walled member, made of a soft malleable metal such as copper. It carries wick 1 in a loose slidable fit within its inner diameter, protruding through one end. The tube end opposite the wick exit point is rigidly attached to the necked down body end section 3. Typical attachment means consist of a tight fit within said body end section 3. Wick 1 is made of any conventional wick material, such as waxed seine twine.

Main body member 5, and its necked down end portion 3, are made of a thermal insulation material such as wood, since this portion of the lighter will provide hand support means.

Wick 1, after passing through adjustable tube 2, further passes into necked down body end section 3. Exit and entrance holes 4, are provided in order to allow outside finger contact with wick 1. After re-entry of wick 1 into main body member 5, the surplus spare length of wick 1 is stored internally in a coiled manner.

Cap 6 is a protective end cap designed to contain and weather protect extra wick 1. It is made of a similar material as the main body, such as wood. Attachment means between cap and body are shown as threads, however, other alternate designs such as snap ridges or a simple slidable fit can be used.

FIG. 2 shows an alternate end cap 7 embodiment. In this design, alternate end cap 7 also serves as a flame extinguisher. End opposite threaded attachment end is made hollow, such that when placed overa single flame point, such as a candle wick, will snuff out said flame.

In both end cap designs, removal of end caps will permit replacement with various handle extensions to lengthen the main body if desired.

In use, the operator first bends the soft metal tube 2 into a compound shape which best fits the space and obstacles in front of the lighting point. Holding the main body member 5 in his hand, the wick 1 is advanced forward by means of finger motion from either the same or opposite hand. Position of wick 1 extending beyond tube 2 end can now be lit. After lighting use is over, the wick is moved back by finger motion, and the flame is extinguished as the burning wick 1 end re-enters the tube 2.

It is to be understood that the foregoing description is merely illustrative of the preferred embodiment of the invention and that the scope of the invention is not to be limited thereto, but is to be determined by the scope of the appended claims.

What I claim is:

1. A firelighting device, comprising:

an inflammable flexible wick taper;

an adjustably shaped semi-rigid tubular member having a first end thereof open to slidably receive said taper therein;

adjustment means to change and hold the shape of said tubular member so as to enable an insertion of said tubular member into a device to be lit which has a recessed fuel source, said insertion bringing said wick taper in close proximity to said fuel source;

an elongate cylindrical handle member circumposed on said adjustable tubular member adjacent the other second end thereof, having means to permit finger axial control of said taper within said tubular member while storing the unused portions of said taper; and an endcap closure to environmentally protect said unused taper portions having means of being secured to the opposite end of said handle member.

2. A firelighting device as recited in claim 1, further comprising:

handle extension means interposed between said handle and said endcap closure.

3. A firelighting device, comprising:

an inflammable flexible wick taper;

an adjustably shaped semi-rigid tubular member having a first end thereof open to slidably receive said taper therein;

adjustment means to change and hold the shape of said tubular member so as to enable an insertion of said tubular member into a device to be lit which has a recessed fuel source, said insertion bringing said wick taper in close proximity to said fuel source;

an elongated cylindrical handle member circumposed on said adjustable tubular member adjacent to the other second end thereof, having means to permit finger axial control of said taper within said tubular member while storing the unused portions of said taper;

an endcap closure to environmentally protect said unused taper portions having means of being secured to the opposite end of said handle member;

handle extension means interposed between said handle and said endcap closure; and a candle flame snuffing means connected to said endcap closure.

4. A firelighting device as recited in claim 3, wherein said candle flame snuffing means is provided by a hollow cavity within said endcap closure having an open after end.

5. A firelighting device as recited in claim 3, wherein said adjustment means consists of bending said semi-rigid tubular member into a desired shape.

6. A firelighting device as recited in claim 5, wherein said finger axial control within said handle member is provided by taper exit and entrance holes on said handle member through which said taper may exit for finger grasping and re-enter said handle for storage.

* * * * *